US012543863B1

(12) United States Patent
Wilson et al.

(10) Patent No.: US 12,543,863 B1
(45) Date of Patent: Feb. 10, 2026

(54) INFLATABLE MATTRESS

(71) Applicant: MAYFAIR AIR, INC., Las Vegas, NV (US)

(72) Inventors: Magdalena Wilson, Salt Lake City, UT (US); Christopher Lee, Salt Lake City, UT (US)

(73) Assignee: MAYFAIR AIR, INC., Las Vegas, NV (US)

( * ) Notice: Subject to any disclaimer, the term of this patent is extended or adjusted under 35 U.S.C. 154(b) by 163 days.

(21) Appl. No.: 18/450,998

(22) Filed: Aug. 16, 2023

Related U.S. Application Data

(60) Provisional application No. 63/352,888, filed on Jun. 16, 2022.

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ..... A47C 27/087; A47C 27/081; A47C 27/10; A47C 27/082; A47C 27/12; A47C 27/127; A47C 27/128; A47C 27/08; A47C 27/18; A47C 27/085; A47C 17/86; A47C 4/54; A47C 27/001; A47C 20/048; A61G 7/05; A61G 7/001; A61G 7/05769; A61G 7/05776; A61G 7/1021; A61G 2200/32; A61G 7/1028
USPC ... 5/710, 711, 706, 712, 737, 738, 690, 716, 5/722, 499, 482, 496, 691, 692, 698, 727, 5/739
See application file for complete search history.

(56) References Cited

U.S. PATENT DOCUMENTS

| | | | | |
|---|---|---|---|---|
| 7,089,618 | B1 * | 8/2006 | Metzger | A47C 27/087 5/709 |
| 11,583,099 | B2 * | 2/2023 | Li | A47C 27/10 |
| 2023/0132601 | A1 * | 5/2023 | Huang | A47C 27/087 5/710 |

FOREIGN PATENT DOCUMENTS

| | | | | |
|---|---|---|---|---|
| CN | 111000399 A | * | 4/2020 | A47C 27/081 |

* cited by examiner

*Primary Examiner* — Madison Emanski
(74) *Attorney, Agent, or Firm* — Perkins Coie LLP

(57) ABSTRACT

An inflatable mattress with a hollow interior cavity is disclosed. An air mattress may include a top panel, a bottom panel, and a plurality of side panels. The air mattress may include a hollow cavity that is configured to be inflated. The air mattress may include a bumper located within the hollow cavity. The bumper may have a bottom side and a top side. The bottom side may extend uninterrupted around a perimeter of the air mattress. The top side may have a plurality of notches. Each of the plurality of notches may be configured to allow for passage of air.

20 Claims, 7 Drawing Sheets

INFLATABLE MATTRESS

CROSS REFERENCE TO RELATED APPLICATIONS

The application claims priority to U.S. Provisional Patent Application Ser. No. 63/352,888, titled "Inflatable Mattress," and filed Jun. 16, 2022. The disclosure of this application is incorporated by reference herein in its entirety.

FIELD OF THE DISCLOSURE

The disclosure relates generally to the field of mattresses. More specifically, the disclosure relates to the field of inflatable mattresses.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In an aspect, an air mattress may include a top panel, a bottom panel, and a plurality of side panels. The air mattress may include a hollow cavity that is configured to be inflated. The air mattress may include a bumper located within the hollow cavity. The bumper may have a bottom side and a top side. The bottom side may extend uninterrupted around a perimeter of the air mattress. The top side may have a plurality of notches. Each of the plurality of notches may be configured to allow for passage of air.

In some aspects, the techniques described herein relate to an inflatable mattress, wherein each of the plurality of notches is V-shaped.

In some aspects, the techniques described herein relate to an inflatable mattress, wherein the plurality of notches includes four V-shaped notches.

In some aspects, the techniques described herein relate to an inflatable mattress, wherein one of the four V-shaped notches is associated with a corner of the inflatable mattress.

In some aspects, the techniques described herein relate to an inflatable mattress, further including a support beam associated with each of the four V-shaped notches.

In some aspects, the techniques described herein relate to an inflatable mattress, wherein the support beam is cylindrical and is vertically disposed within the hollow cavity.

In some aspects, the techniques described herein relate to an inflatable mattress, further including a second bumper.

In some aspects, the techniques described herein relate to an inflatable mattress, wherein the bumper is associated with an upper side of the inflatable mattress and the second bumper is associated with a lower side of the inflatable mattress.

In some aspects, the techniques described herein relate to an inflatable mattress, further including a plurality of supportive coils.

In some aspects, the techniques described herein relate to an inflatable mattress, wherein at least some of the plurality of supportive coils are oblong.

In some aspects, the techniques described herein relate to an inflatable mattress, wherein at least some of the plurality of supportive coils are cylindrical.

In some aspects, the techniques described herein relate to an inflatable mattress, wherein a bottom seam uninterruptedly couples the bottom side of the bumper to at least one of the plurality of side panels.

In some aspects, the techniques described herein relate to an inflatable mattress, wherein a plurality of top seams couple the top side of the bumper to the top panel.

In some aspects, the techniques described herein relate to an inflatable mattress, wherein two adjacent seams of the plurality of seams have a space therebetween.

In some aspects, the techniques described herein relate to an inflatable mattress, including: a top panel, a bottom panel, and a plurality of side panels; a hollow cavity configured to be inflated; and a bumper located within the hollow cavity. The bumper has a bottom side and a top side. The bottom side extends uninterrupted around a perimeter of the inflatable mattress and is coupled to the plurality of side panels. The top side has a plurality of notches. Each of the plurality of notches is configured to allow for passage of air.

In some aspects, the techniques described herein relate to an inflatable mattress, wherein the top side is coupled to the top panel.

In some aspects, the techniques described herein relate to an inflatable mattress, wherein each of the plurality of notches is symmetrical.

In some aspects, the techniques described herein relate to an air mattress, including: a hollow interior cavity configured to be inflated with a fluid; and a bumper situated within the interior cavity. The bumper has sections that inflate when the hollow interior cavity is inflated with the fluid. The bumper has a continuous bottom edge and a discontinuous top edge. The discontinuous top edge has associated therewith a plurality of notches. Each of the plurality of notches has associated with one corner of the air mattress.

In some aspects, the techniques described herein relate to an air mattress, further including a support beam associated with each of the plurality of notches.

In some aspects, the techniques described herein relate to an air mattress, wherein the bumper is associated with an upper side of the air mattress.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

Illustrative embodiments of the present disclosure are described in detail below with reference to the attached drawing figures and wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or limit the disclosure to the precise forms disclosed.

In the following description, specific details are set forth to provide a thorough understanding of exemplary embodiments of the present disclosure. However, it will be apparent to one skilled in the art that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

An air mattress, also known as an airbed, inflatable mattress, or a blow-up bed, is an inflatable mattress which may comprise polyvinyl chloride (PVC) or textile-reinforced urethane plastic or rubber, among other materials and fabrics. Air mattresses are incredibly portable as a deflated mattress can be compacted and carried or stored in a small form. Typically, air mattresses are inflated by blowing into a valve, either with a manual or an electric pump. Some are automatically inflated when a valve is opened, up to a certain pressure with additional inflation manually or by pump.

Air mattresses are popular for their compact storage and multiple uses such as camping, temporary or full-time home use. Some air mattresses may be optimized to combine several uses (e.g., camping and guest use) while others are single purpose. Most air mattresses tend to mimic the appearance and comfort of a traditional mattress.

Figure 1:
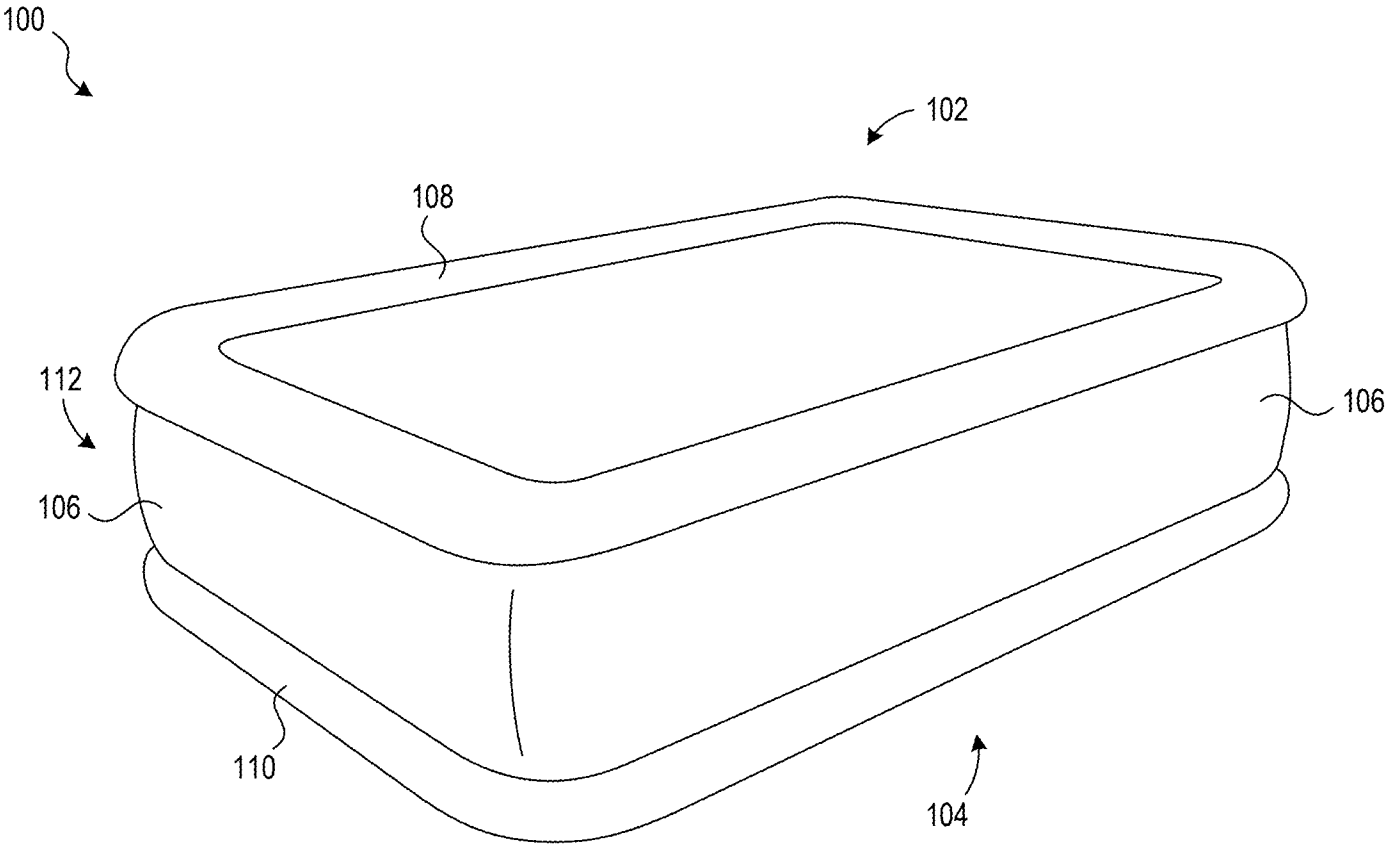
FIG. 1 is a perspective view of an air mattress in accordance with an example embodiment.

FIG. 1 illustrates an air mattress 100 with a top panel 102 and a bottom panel 104 positioned opposite the top panel 102. The air mattress 100 may include one or more side panels 106. For example, each side of the air mattress 100 may include a different panel 106 with a seam at a corner (e.g., corner 112). In some embodiments, the mattress 100 may have one or more bumpers 108, 110. In some embodiments, the mattress 100 may only have a top-side bumper 108. In further embodiments, the mattress 100 may have a bottom bumper 110. In some instances, the bumpers 108, 110 may be symmetrical. In other embodiments, the bumpers 108, 110 may be asymmetrical.

The air mattress 100 may include any size of mattress include twin, full, queen, king, twin XL, California king, and the like. The mattress 100 may also be sized for specific uses such as in a vehicle, bed of a pick-up truck, tent, and the like. The air mattress 100 may also vary in height. For example, in some embodiments, the air mattress 100 may be as slim as approximately six (6) inches or as thick as twenty-four (24) inches. These depths are meant to be illustrative and not independently limiting.

Figure 2A:
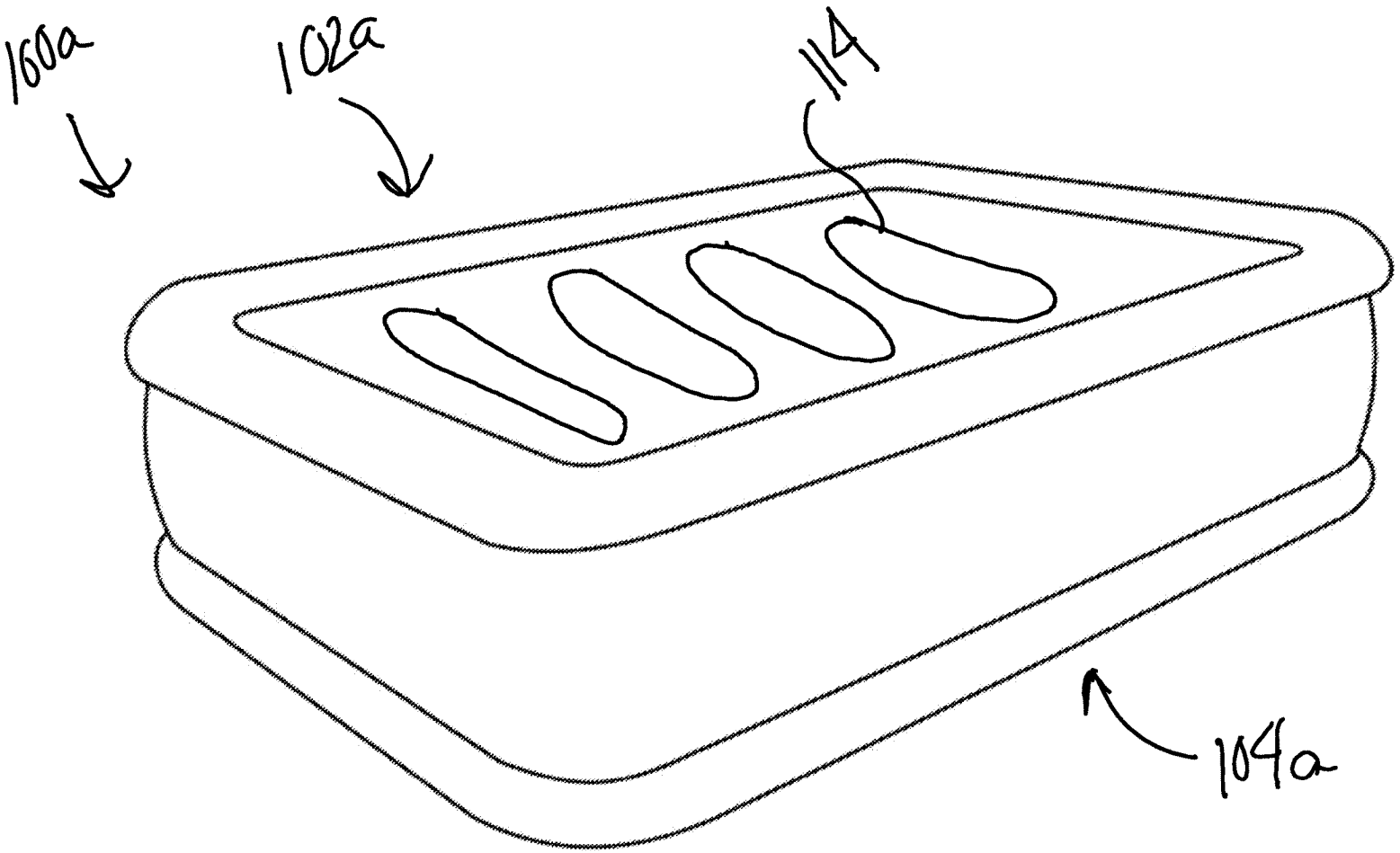
FIG. 2A is a perspective view of an air mattress in accordance with another example embodiment.
Figure 2B:
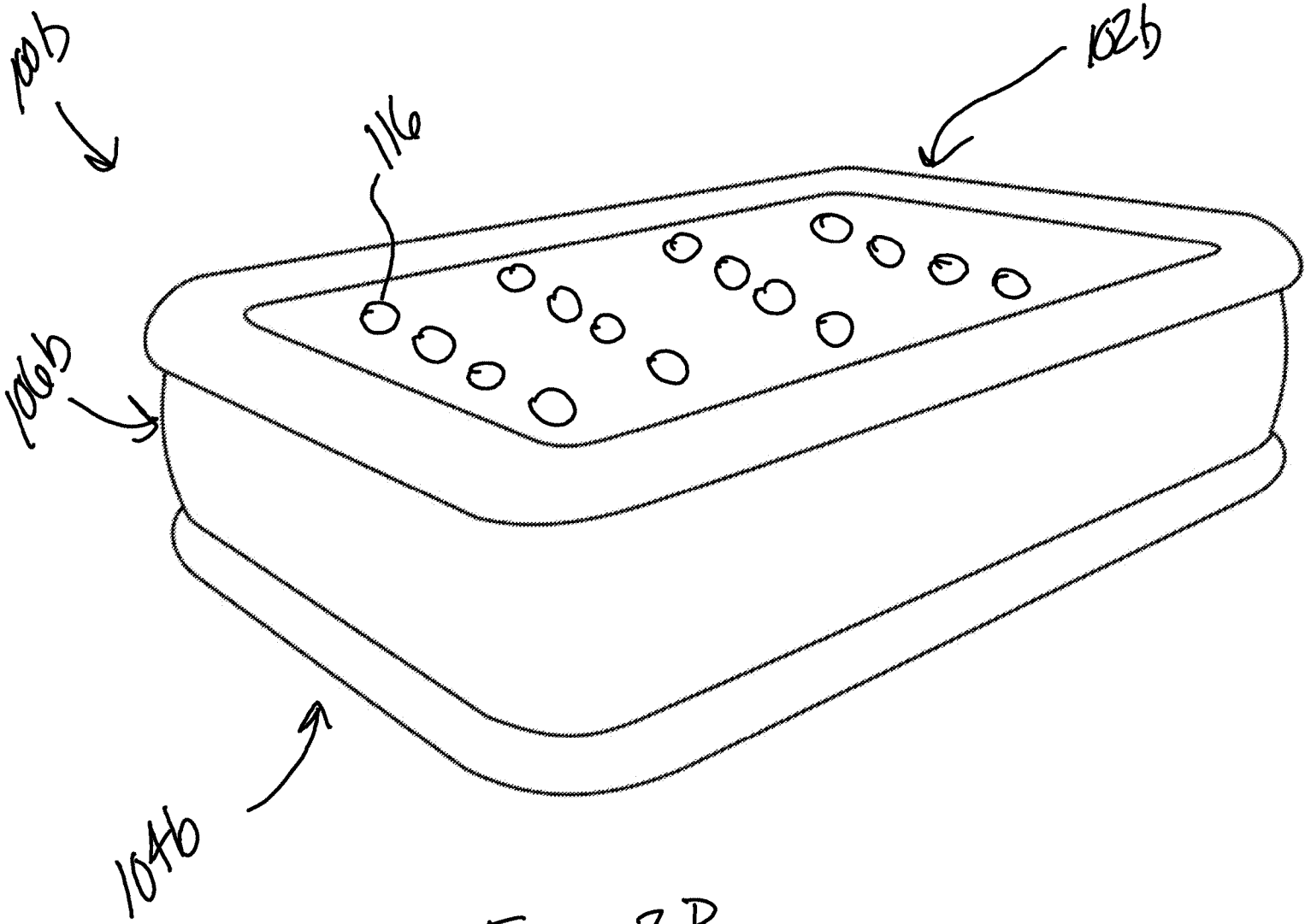
FIG. 2B is a perspective view of an air mattress in accordance with another example embodiment.
Figure 2C:
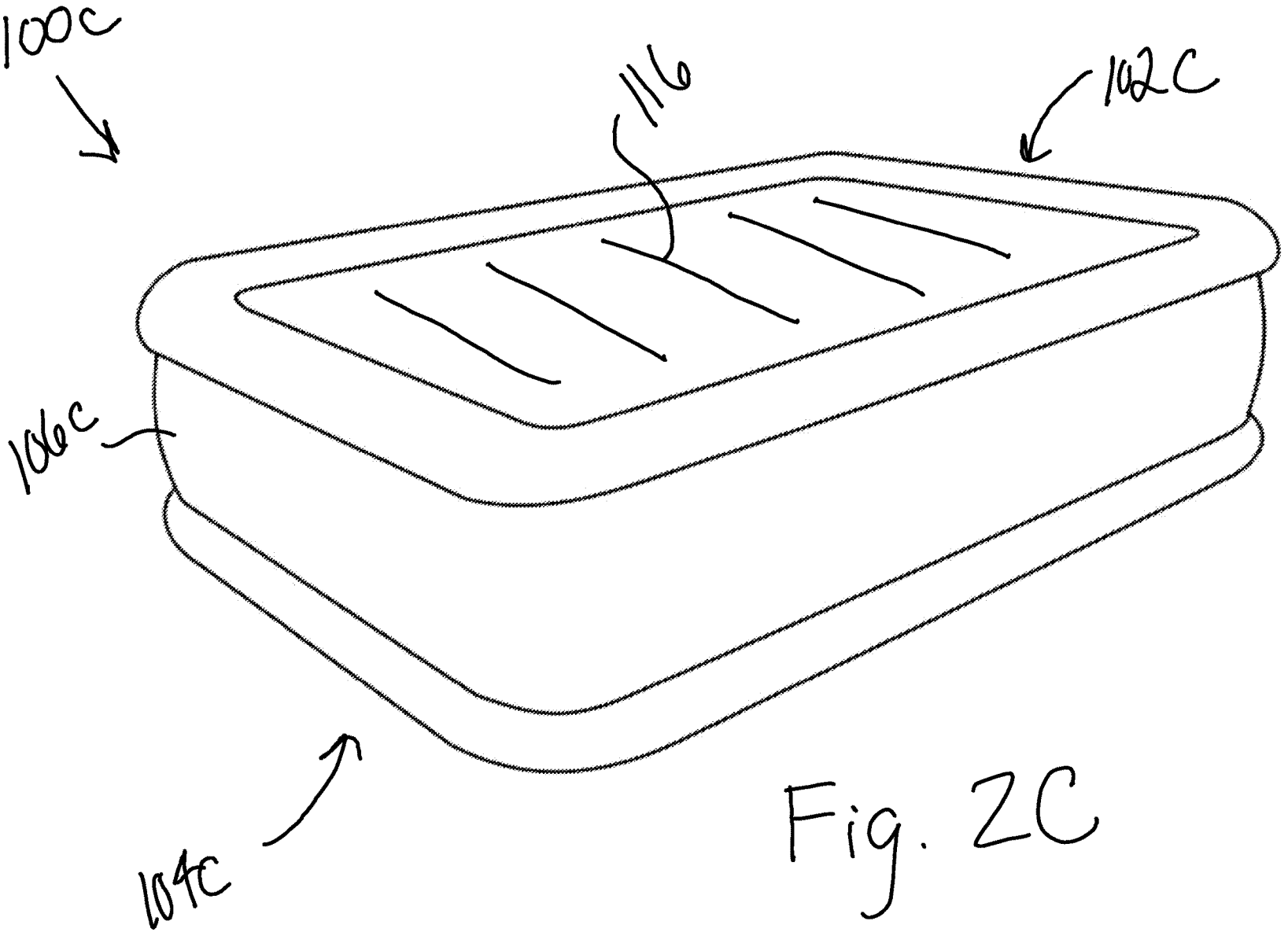
FIG. 2C is a perspective view of an air mattress in accordance with another example embodiment.

FIGS. 2A, 2B, and 2C respectively depict mattresses 100*a*, 100*b*, and 100*c*. The mattresses 100*a*, 100*b*, and 100*c* have disparate appearances. The differences in the appearance of the mattresses 100*a*, 100*b*, and 100*c* may be due to the interior structure of these air mattresses. For example, the interior structure of the air mattress 100 reflects the outward appearance of the air mattress.

As shown in FIG. 2A, the mattress 100*a* has oblong shaped features 114 on a top surface 102*a* of the mattress 100*a*. The mattress 100*a* may also have symmetrical oblong shaped features 114 on a bottom side or panel 104*a* of the mattress. The oblong-shaped features 114 may be a result of coils in the internal structure of the air mattress. The internal coils or pieces of material may connect the top panel 102*a* of the mattress 100*a* with the bottom panel 104*a* of the mattress and may enable the mattress 100*a* to maintain a substantially rectangular shape. The coils may also be vertical pulling bands or other structures that couples one side of the mattress to another opposing side.

FIG. 2B displays another variation of a top panel 102*b* design of an air mattress 100*b*. In this variation, the mattress 100*b* may have any number of circles 116 as coils or connectors. The circles 116 may be spaced between the top panel 102*b* and bottom panel 102*c* of the mattress 100*b*. The circles 116 may appear in organized rows as shown in FIG. 2B, or they may be in a different pattern or no pattern at all.

FIG. 2C shows another variation of a mattress 100*b* with a series of lines or rows 116. The lines or rows 116 are another variation of vertical pulling bands to allow the mattress 100*c* to maintain its shape.

Figures 3, 4:
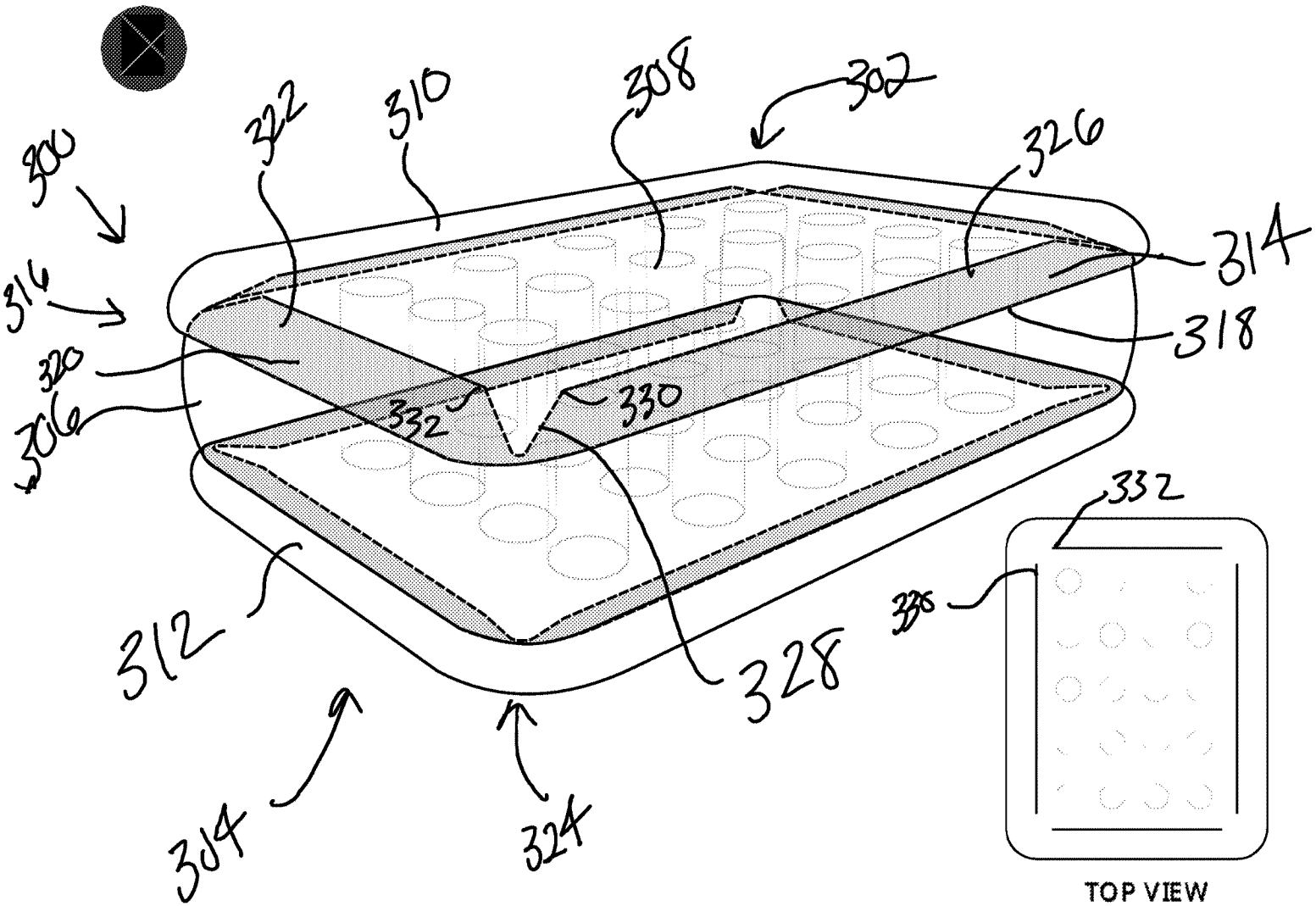
FIG. 3 is a schematic view of an air mattress in accordance with an example embodiment.
FIG. 4 is a top-down view of an air mattress in accordance with an example embodiment.

FIG. 3 shows an air mattress 300 with an internal structure to create a bumper feature 310 on the upper side and a corresponding bumper feature 312 on the lower side. The air mattress 300 may be any of the air mattresses discussed with references to FIGS. 1 and 2A-2C.

The air mattress 300 may include a top panel 302, a bottom panel 304 (see FIG. 5) opposite the top side 302 and one or more side panels 306 or peripheral panels connecting the top side 302 to the bottom side 304. As discussed previously, one or more coil features 308 may also couple the top panel 302 to the bottom panel 304. In this embodiment, the coil feature 308 is a symmetrical display of circular coils, but as discussed, the coil feature may take any pattern, shape, or form.

In some embodiments, the air mattress 300 may include a bumper feature 310 associated with the upper side of the mattress 300, and alternately or in addition, a bumper feature 312 associated with the lower side of the mattress. The coils 308 may give the mattress 300 the appearance of a pillow top mattress. The bumper features 310, 312 may also provide horizontal and vertical stability to the air mattress 300. For example, the tensile reinforcement offered by the bumper 310, 312 may prevent undesirable deformation of the mattress 300 when a weight, such as a person, is resting on top of the mattress 300. The interior structure that forms the bumper may prevent the sides 306 of the mattress 300 from expanding horizontally and may prevent the top of the mattress 300 from expanding vertically during use.

The feature displayed in FIG. 3 shows a support beam or bumper panel 314 spanning around the circumference of a top portion of the 316 of the mattress 300. The bumper panel 314 may be located, in embodiments, entirely or partially within the hollow cavity of the mattress 300. Air may be able to pass through the bumper panel 314 into the hollow interior cavity and vice versa, as discussed herein. As is known, the hollow cavity of the mattress 300 may be inflated with fluid (e.g., air) using any suitable means, e.g., a pump may be used to pump air into the hollow cavity via an opening that may be selectively closable. Air may likewise be pumped out or simply let out of the mattress 300 via one or more openings to deflate the mattress. When air is pumped into the hollow cavity of the mattress 300, the air may inflate the hollow cavity as well as one or more sections of the bumper panel 314.

The bumper panel 314 may have a continuous seam on a lower edge 318 of the beam 314. For example, in some embodiments, a bottom portion 320 of the beam 314 may extend uninterrupted around the perimeter of the mattress. As shown in the corners 324, the bottom edge 318 of the bumper panel 314 is continuous with a seam bonding the edge 318 to the side panel(s) 306 of the mattress 300. This continuous seam may provide a continuous support system to the mattress 300.

In some embodiments, a top portion 326 of the bumper panel 314 may be interrupted. For example, the top edge 326 of the bumper panel 314 may not be continuous. In the illustrated example, the top portion 326 of the bumper panel 314 is shown to be interrupted in one or more corners 324 of the mattress 300. For example, as shown, the top portion 326 of the bumper panel 314 may be interrupted by one or more notches, such as a notch 328 or other discontinuity at each of the four corners of the mattress 300.

If the notch 328 or other discontinuity were absent, the bumper 310 may form a continuous fluid chamber (e.g., air may be filled into the bumper via an entry point and the air may flow generally uninterrupted within the bumper 310. The notch 328 (or other such discontinuity) may prevent the bumper 310 from creating a continuous fluid vessel. For example, air may not flow uninterrupted from the bumper panel associated with the side of the mattress 300 to the bumper panel associated with the front or the back of the mattress, but instead, may at least largely escape through the notch 328 into the main hollow cavity of the mattress 300.

The notch 328 shown is V-shaped, however, the shape and size of the notch may vary. For example, the notch 328 may have a frusto-triangular shape, an arced shape, a generally V-shape (e.g., a V with curved sides), a taper, or another symmetrical or asymmetrical shape. Additionally, as shown, the notch 328 is in an upper portion 322 of the bumper panel 314, but the design could be reversed and the notch 328 could be located on a bottom portion of the bumper panel 314. In some aspects, in addition to or in lieu of the corners, the notch 328 or discontinuity may be provided elsewhere. In some aspects, a fewer or greater number of notches (e.g., 1 notch, 2 notches, 3 notches, 8 notches, et cetera) per bumper may be provided. The shape, size, and location of the notch(es) 328 may affect the supportability of the mattress 300, the appearance of the mattress 300, and/or the workings thereof (e.g., may impact the travel of air between the bumper and the main hollow cavity).

In an embodiment, notch 328 may have a first corner 330 and a second corner 332. The first corner 330 of the beam 314 may end proximate to the corner 324 of the mattress 300 as shown in FIG. 4. A second corner 332 may then continue along a second edge of the air mattress 300. The distance between the first corner 330 and second corner 332 may be wide enough to allow air to flow into the compartment formed by the bumper panel 314 without having to create punctures or other holes in the panel itself.

FIG. 4 shows a top-down view of the bumper panel 314 with notches 328 in each of the four corners of the mattress. This is merely exemplary. The mattress 300 may contain a single notch in a single corner, or any number of notches. The notches may be located in the corners as shown or may be located along an edge of the mattress 300. In some embodiments, the bumper feature may be located on a top side or bottom side of the mattress, or on both. the features may be symmetrical or asymmetrical. The notches 328 may be arranged to give the mattress 300 the appearance or general appearance of a pillow top mattress, a Euro top mattress, or another mattress.

Figure 5:
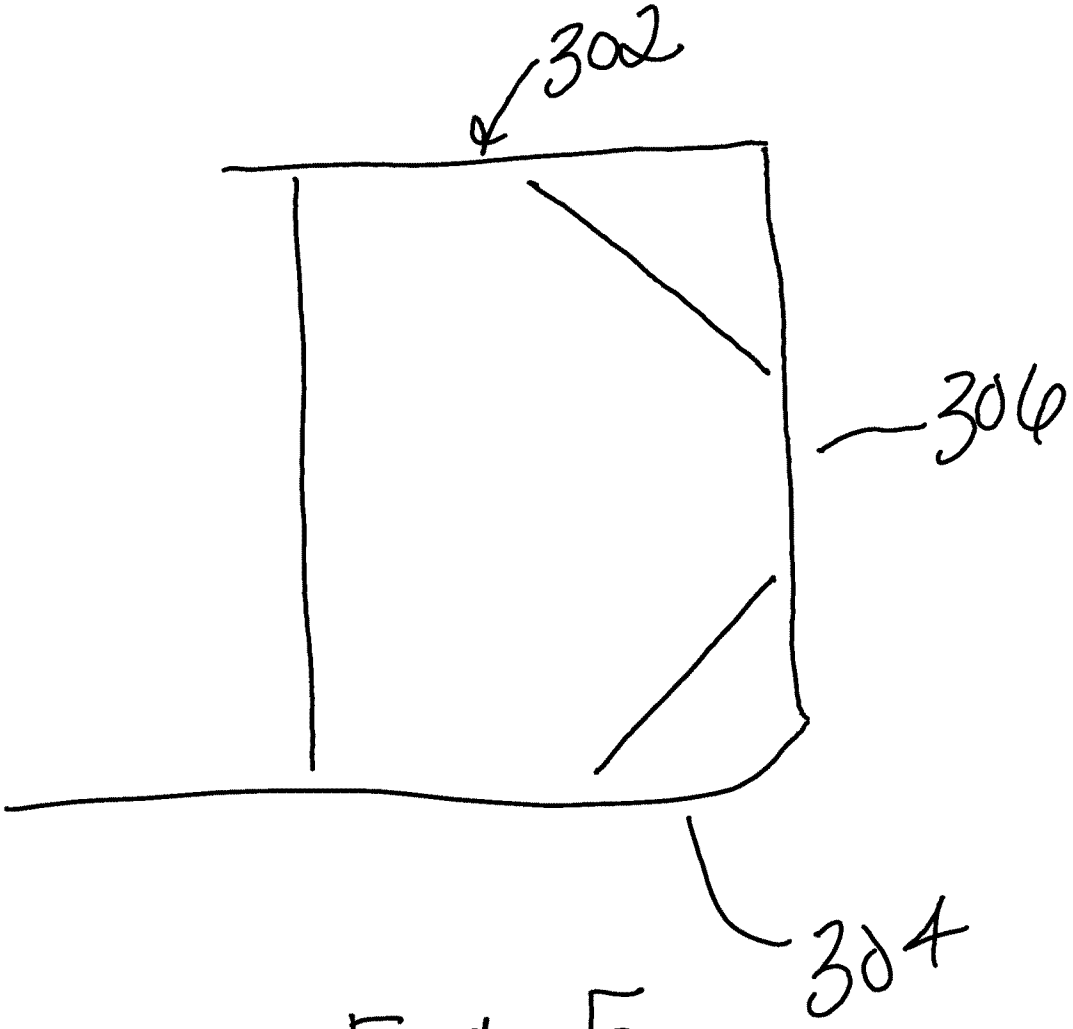
FIG. 5 is a cutaway view of the air mattress in FIG. 3, in accordance with an embodiment.

FIG. 5 is a side cutaway view of the support beam 314 on one side of the mattress 300. In some embodiments, the mattress 300 may contain a similar beam 336 on an opposing side of the mattress. In some embodiments, both beams 314, 336 may mirror the other design. In further embodiments, the beams 314, 336 may be dissimilar.

Figures 6, 7:
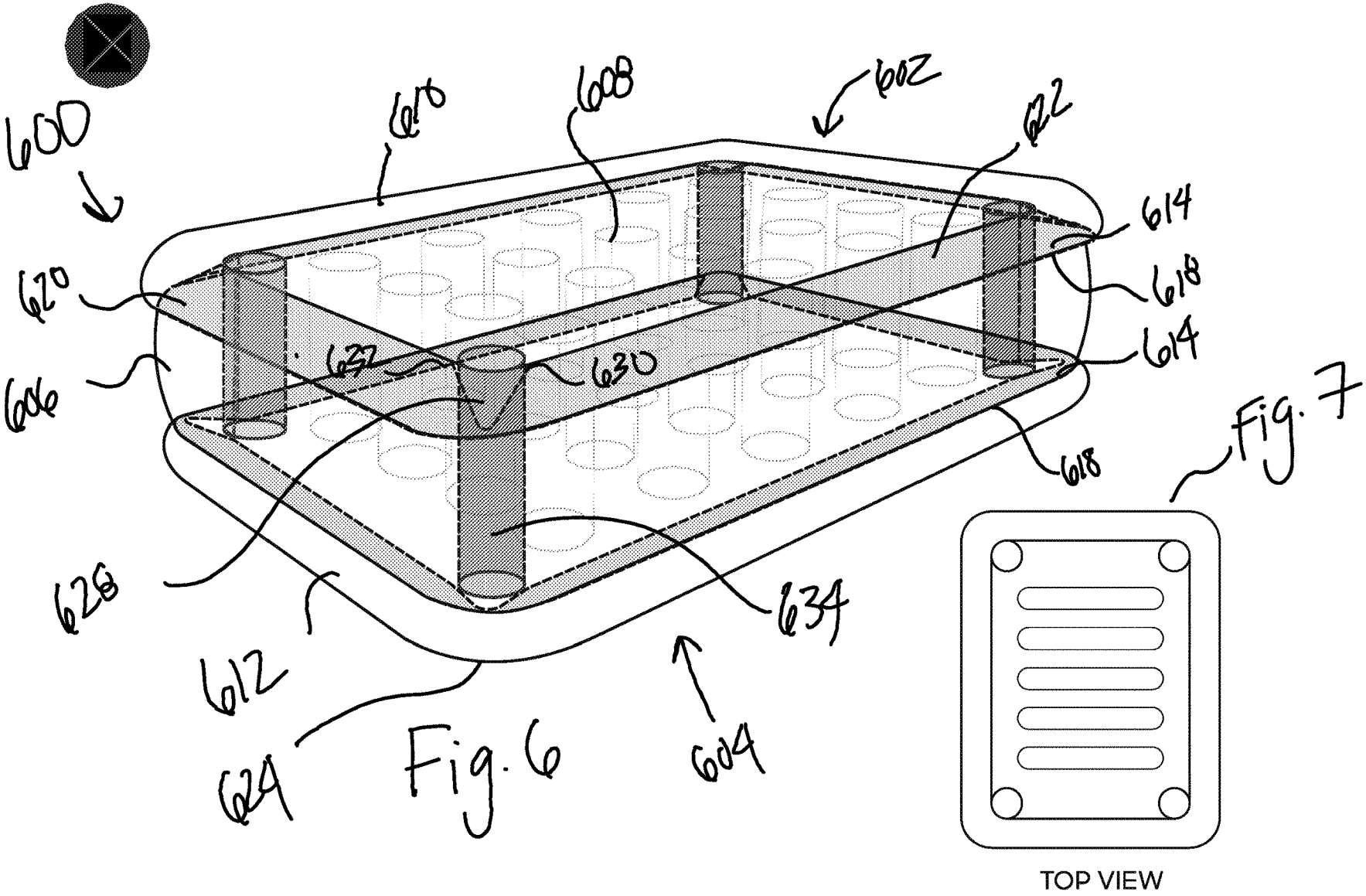
FIG. 6 is an isometric view of another air mattress, in accordance with an example embodiment.
FIG. 7 is a top-down view of the air mattress shown in FIG. 6, in accordance with an embodiment.

FIG. 6 is an isometric view of another air mattress 600 in accordance with embodiments described herein. The air mattress 600 may be an example of air mattress 100 and may also incorporate features or be an example of air mattress 300.

The air mattress 600 has an internal structure to create a bumper feature 610, 612. The air mattress 600 may include a top side or panel 602, a bottom side or panel 604 opposite the top side panel 602 and one or more side or panels 606 or peripheral panels connecting the top panel 602 to the bottom panel 604. As discussed previously, one or more coil features 608 may also couple the top panel 602 to the bottom panel 604. In this embodiment, the coil feature 608 is a symmetrical display of cylindrical coils, but as discussed, the coil feature may take any pattern, shape, or form.

In some embodiments, the air mattress 600 may include a bumper feature 610, 612. The bumper feature 610, 612 may operate similar to the bumper feature 310, 312 described in reference to FIG. 3, and may be located in whole or in part within the hollow interior cavity of the air mattress 600.

In some embodiments, at least one of the bumper features 610, 612 may have a support beam 614 spanning around the circumference of a top portion of the 616 of the mattress 600. The support beam 614 may couple the top side 602 of the mattress to one or more side panels 606, similar to the mattress 300 as shown in FIG. 5.

The mattress 600 may include a bumper feature 610, 612 very similar to the bumper feature 310, 312, described in reference to FIGS. 3-5. However, the mattress 600 includes an additional support column where the panel 614 has a notch 628 or break.

For example, the notches 628 are located in the corners 624 of the mattress 600. In some embodiments, a tensioning member or beam 634 may be located proximate the notches 628. The tensioning member 634 as shown may span the interior volume of the mattress coupling the top side 602 of the mattress 600 to the bottom side 604 of the mattress. The tensioning member 634 may provide additional support in the corners. The tensioning feature 634 may additionally provide an aesthetic look to the mattress as shown in FIG. 7. Additionally, the tensioning member 634 is shown as circular but the tensioning member 634 may comprise other shapes and sides. For example, is some embodiments, the tensioning feature may be an arcuate sheet that spans the distance between the corners 630, 632 of the notches. This may cause a singular seam to appear on a top side of the mattress 600. Likewise, these features could be mirrored to the bottom side 604 of the mattress as well.

In some embodiments, the vertical support beam 634 is located in each corner of the mattress 600. In further embodiments, the mattress 600 includes at least one vertical support beam 634. The vertical support beam 634 may comprise a variety of shapes and sizes. In the embodiment shown, the vertical support beam 634 is circular in appearance and the radius of the circle mimics a radius of the corner 624 it is proximate. In further embodiments, the vertical support beam 634 may be linear, polygonal, or a variety of shapes and sizes to provide vertical support to the mattress 600. In still further embodiments, the vertical support beam 634 could mimic a decorative shape such as a star, moon, cloud, and the like. If four support beams are present, as shown in FIG. 7, the vertical support beams 634 may present a symmetrical design when viewing from the top down.

Additionally, in the embodiments shown, the notch 628 is located along the top panel 622 of the support beam 614. In other embodiments, the notch 628 may be located along a bottom panel 620 of the support beam 614. In still further embodiments, the notch 628 may be located on one side in one corner and on a different side in a different corner.

A person skilled in the art will be able to practice the present invention after careful review of this description, which is to be taken as a whole. Details have been included to provide a thorough understanding. In other instances, well-known aspects have not been described in order to prevent unnecessarily obscure this description.

Some technologies or techniques described in this document may be known. Even then, however, it is not known to apply such technologies or techniques as described in this document or for the purposes described in this document.

This description includes one or more examples, but this fact does not limit how the disclosure may be practiced. Indeed, examples, instances, versions, or embodiments of the disclosure may be practiced according to what is described, or yet differently, and also in conjunction with other present or future technologies. Other such embodiments include combinations and sub-combinations of features described herein, including, for example, embodiments that are equivalent to the following: providing or applying a feature in a different order than in a described embodiment; extracting an individual feature from one embodiment and inserting such feature into another embodiment; removing one or more features from an embodiment, or both removing a feature from an embodiment and adding a feature extracted from another embodiment while providing the features incorporated in such combinations and sub-combinations.

In general, the present disclosure reflects preferred embodiments of the invention. The attentive reader will note, however, that some aspects of the disclosed embodiments extend beyond the scope of the claims. To the respect that the disclosed embodiments indeed extend beyond the scope of the claims, the disclosed embodiments are to be considered supplementary background information and do not constitute definitions of the claimed invention.

In this document, the phrases "constructed to," "adapted to," and/or "configured to" denote one or more actual states of construction, adaptation, and/or configuration that is fundamentally tied to physical characteristics of the element or feature preceding these phrases and, as such, reach well beyond merely describing an intended use. Any such elements or features can be implemented in a number of ways, as will be apparent to a person skilled in the art after reviewing the present disclosure, beyond any examples shown in this document.

Incorporation by reference: References and citations to other documents, such as patents, patent applications, patent publications, journals, books, papers, web contents, have been made throughout this disclosure. All such documents are hereby incorporated herein by reference in their entirety for all purposes.

Reference numerals: In this description, a single reference numeral may be used consistently to denote a single item, aspect, component, or process. Moreover, a further effort may have been made in the preparation of this description to use similar though not identical reference numerals to denote other versions or embodiments of an item, aspect, component, or process that are identical or at least similar or related. Where made, such a further effort was not required but was nevertheless made gratuitously so as to accelerate comprehension by the reader. Even where made in this document, such a further effort might not have been made completely consistently for all of the versions or embodiments that are made possible by this description. Accordingly, the description controls defining an item, aspect, component, or process rather than its reference numeral. Any similarity in reference numerals may be used to infer a similarity in the text, but not to confuse aspects where the text or other context indicates otherwise.

The claims of this document define certain combinations and sub combinations of elements, features, and acts or operations, which are regarded as novel and non-obvious. The claims also include elements, features, and acts or operations that are equivalent to what is explicitly mentioned. Additional claims for other such combinations and sub combinations may be presented in this or a related document. These claims are intended to encompass within their scope all changes and modifications that are within the true spirit and scope of the subject matter described herein. The terms used herein, including in the claims, are generally intended as "open" terms. For example, the term "including" should be interpreted as "including but not limited to," the term "having" should be interpreted as "having at least," etc. If a specific number is ascribed to a claim recitation, this number is a minimum but not a maximum unless stated otherwise. For example, where a claim recites "a" component or "an" item, it means that the claim can have one or more of this component or this item.

In construing the claims of this document, the inventor(s) invoke 35 U.S.C. § 112(f) only when the words "means for" or "steps for" are expressly used in the claims. Accordingly, if these words are not used in a claim, then that claim is not intended to be construed by the inventor(s) in accordance with 35 U.S.C. § 112 (f).

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An inflatable mattress, comprising:

a top panel, a bottom panel, and a plurality of side panels;

a hollow cavity, said hollow cavity configured to be inflated;

a bumper located within said hollow cavity, said bumper having a bottom side and a top side, said bottom side extending uninterrupted around a perimeter of the inflatable mattress, said top side having a plurality of notches, each of said plurality of notches configured to allow for passage of air, wherein said plurality of notches includes four V-shaped notches; and a support beam associated with each of said four V-shaped notches, wherein one of said four V-shaped notches is associated with a corner of said inflatable mattress.

2. The inflatable mattress of claim 1, wherein each of said plurality of notches is V-shaped.

3. The inflatable mattress of claim 1, wherein said support beam is cylindrical and is vertically disposed within the hollow cavity.

4. The inflatable mattress of claim 3, further comprising a second bumper.

5. The inflatable mattress of claim 4, wherein said bumper is associated with an upper side of said inflatable mattress and said second bumper is associated with a lower side of said inflatable mattress.

6. The inflatable mattress of claim 1, further comprising a plurality of supportive coils.

7. The inflatable mattress of claim 6, wherein at least some of said plurality of supportive coils are oblong.

8. The inflatable mattress of claim 6, wherein at least some of said plurality of supportive coils are cylindrical.

9. The inflatable mattress of claim 1, wherein a bottom seam uninterruptedly couples said bottom side of said bumper to at least one of said plurality of side panels.

10. The inflatable mattress of claim 1, wherein a plurality of top seams couple said top side of said bumper to said top panel.

11. The inflatable mattress of claim 10, wherein two adjacent seams of said plurality of seams have a space therebetween.

12. An inflatable mattress, comprising:

a top panel, a bottom panel, and a plurality of side panels;

a hollow cavity, said hollow cavity configured to be inflated;

a bumper located within said hollow cavity, said bumper having a bottom side and a top side, said bottom side extending uninterrupted around a perimeter of the inflatable mattress and being coupled to said plurality of side panels, said top side having a plurality of notches, each of said plurality of notches configured to allow for passage of air;

an upper support beam coupled to the top panel and at least one of said plurality of side panels; and a lower support beam coupled to the bottom side and one or more of said plurality of side panels.

13. The inflatable mattress of claim 12, wherein said top side is coupled to said top panel.

14. The inflatable mattress of claim 12, wherein each of said plurality of notches is symmetrical.

15. The inflatable mattress of claim 12, wherein said upper support beam extends around three sides of said inflatable mattress, wherein said three sides include two longest sides of said inflatable mattress.

16. The inflatable mattress of claim 12, wherein said lower support beam includes discrete panels on opposing sides of said inflatable mattress.

17. An air mattress, comprising:

a hollow interior cavity configured to be inflated with a fluid;

a bumper situated within said interior cavity, said bumper having sections that inflate when said hollow interior cavity is inflated with said fluid, said bumper having a continuous bottom edge and a discontinuous top edge, said discontinuous top edge having associated therewith a plurality of notches, each of said plurality of notches associated with one corner of said air mattress; and a support beam associated with each of said plurality of notches.

18. The air mattress of claim 17, wherein said bumper is associated with an upper side of said air mattress.

19. The air mattress of claim 17, wherein said support beam is configured to be inflated.

20. The air mattress of claim 17, wherein said support beam is inflatable separately from said hollow interior cavity.

* * * * *